109-16 SR

2/1/77 OR 4,005,662

United States Patent [19]

Kohn et al.

[11] 4,005,662

[45] Feb. 1, 1977

[54] ARMOR WINDOW

[76] Inventors: Robert A. Kohn; Karen Kohn, both of 3902 E. Weldon Ave., Phoenix, Ariz. 85018

[22] Filed: Mar. 21, 1975

[21] Appl. No.: 560,791

[52] U.S. Cl. ..... 109/16; 109/21.5; 350/285; 350/301; 49/77

[51] Int. Cl.[2] ..... E05G 7/00

[58] Field of Search ..... 109/21.5, 10, 15, 49.5, 109/16; 350/285, 301; 49/77

[56] References Cited

UNITED STATES PATENTS

| | | | |
|---|---|---|---|
| 1,519,553 | 12/1924 | Riker | 109/16 X |
| 1,834,036 | 12/1931 | Simpson | 109/16 X |
| 1,859,013 | 5/1932 | Wise | 109/21.5 |
| 3,510,206 | 5/1970 | Smith | 350/285 X |

FOREIGN PATENTS OR APPLICATIONS

| | | | |
|---|---|---|---|
| 866,233 | 7/1941 | France | 350/301 |
| 530,932 | 7/1931 | Germany | 109/10 |
| 1,708,482 | 3/1970 | Germany | 109/10 |

*Primary Examiner*—Paul R. Gilliam
*Assistant Examiner*—David H. Corbin
*Attorney, Agent, or Firm*—Watson D. Harbaugh

[57] ABSTRACT

An armor window through which air, sound and sight without inversion will pass freely yet sight can be selectively obstructed and at all times the flight of a propelled element at any angle will be obstructed by at least two spaced angle iron members with the further high probability of propelled elements, including harmful liquids, being substantially and safely deflected.

4 Claims, 9 Drawing Figures

ARMOR WINDOW

BACKGROUND OF INVENTION

Heretofore, where money exchanges hands, bullet proof windows are generally employed and made of thick shatter proof transparent materials such as single panes of tempered glass mounted in frames with or without integrated re-inforcement. Although they discourage fire arm threats they do not permit air or sound to pass through them. This requires other means for transmitting air and sound in addition to sight if the barrier is too high to scale or the cashier's booth is enclosed. Moreover, if damaged by a bullet they have to be completely replaced, and, if it is desirable to obstruct sight as when "closed," an additional member such as a shade or curtain must be drawn which takes up a substantial amount of space.

SUMMARY OF INVENTION

Considering in this connection protection against 0.037 magnum ball ammunition which generally propels a 158 grain projectile at a velocity of 1,375 feet per second, it may be noted that the hardness of metal armor is a primary consideration. However, maximum expected impact can also be resisted by the number of metal layers confronting direct passage of the bullet as well as by varying the thickness or size of the metal members employed.

Although small right angle bars ⅝ inch wide with 0.44 inch sides 1/32 inch thick and having a BHN of 260, spaced 5/16 inch from each other, may serve as armor in the invention, it is preferred to use larger right angle bars of like hardness, referred to herein as angle irons, having a hypotenuse width of 2 inches with ¼ inch flanges that are 1/16 inch thick and spaced 1 inch from each other, corner to corner, to provide a minimum overlap of approximately the thickness of the metal. They are strongly supported to provide an acceptable armor window, permit direct transmission of air and sound and for optical reasons provide wider uninterrupted reflecting areas and the appearance of greater strength against crowbar mutilation if the window happens to be within reach of a malefactor seeking to establish a spread large enough for a gun shot flight pattern dangerous to personnel. At a safe "beyond-reach" distance the armor window will provide the same viewing area as the smaller size angle irons as located to overlap enough to prevent any straight line of sight, the flight of a bullet or liquid squirted therethrough. Moreover, in embodiment alternate angle irons can be pivoted slightly as a unit to block sight and act as a "shutter" if a booth is "closed."

In both embodiments a perception angularity is provided of at least 6° between adjacent angle irons from a fixed viewing point, or an overlapping continuous picture up to 45° merely by horizontal movement of the viewers head to look through vertically disposed angle irons. The horizontal viewing angle with the angle irons disposed horizontally can exceed 60°. Thereby, the window can be used as an inspection window for enclosed installations of electrical equipment were continuing air flow and critical visual inspections can be made without unlocking protective enclosures or danger of them being damaged.

IN THE DRAWINGS

DESCRIPTION OF THE EMBODIMENT

Figure 1:
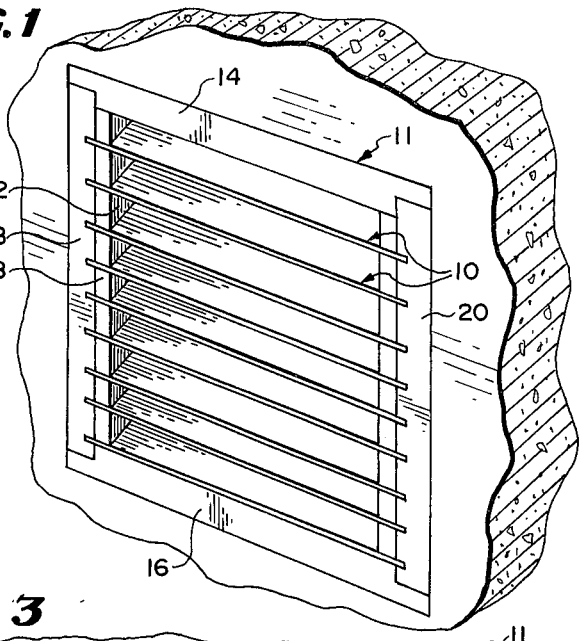
FIG. 1 is a perspective view of an armor window embodying the invention mounted in a solid wall with the top and bottom angle irons partially resting in view obstructing relation with the adjacent walls of the frame.
Figure 2:
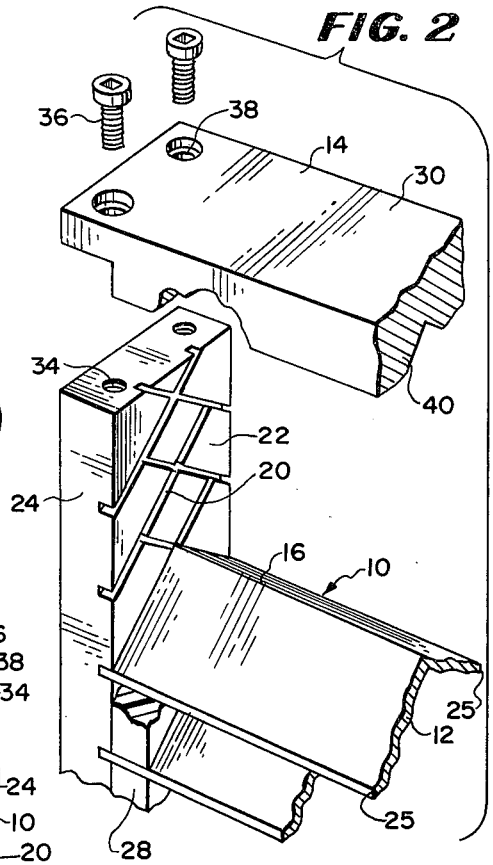
FIG. 2 is an exploded view of one corner of the preassembled window.
Figure 3:
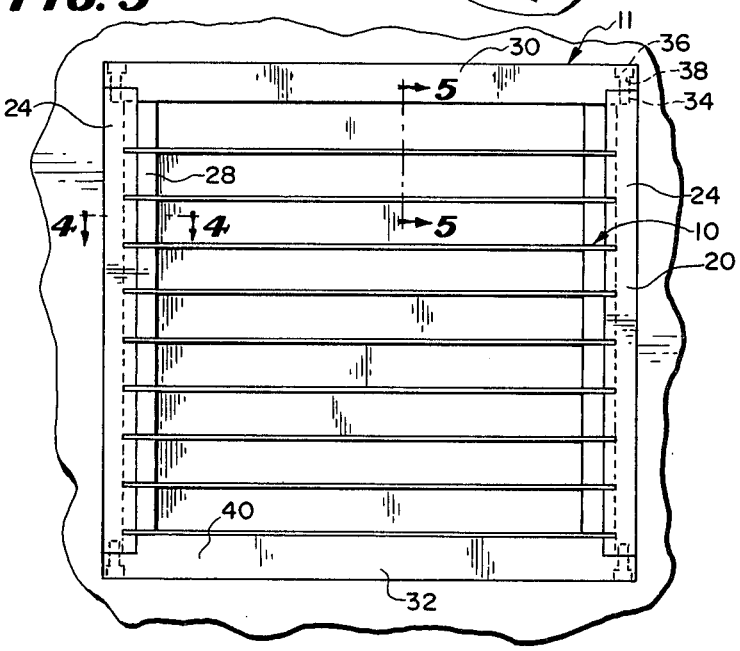
FIG. 3 is a front view of the armor window before the window casing is applied.
Figure 4:
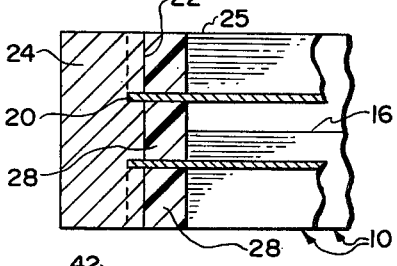
FIG. 4 is a longitudinal sectional view taken on line 4—4 of FIG. 3.

Referring to the drawings of the armor window 11 in further detail, the angle irons 10 are substantially identical, except as to length in FIGS. 6–9, and each has two substantially identical flanges 12 with mirror surfaces 14 on opposite sides. The flanges are preferably disposed at a right angle to each other as integrally joined along proximate edges to form an apex 16.

The angle irons 10 are terminally supported in symmetrically facing right angle grooves 20 provided in opposing faces 22 of opposing frame members 24 with the apex of each transgressing the plane defined by the edges 25 of the angle iron next to it. This arrangement blocks a direct line of sight between them. The ends of the angle irons 10 are held rigidly in the grooves 20 under endwise compression by cross-members 30 and 32, preferably with a thickness of epoxy 28 serving as rigidifying elements between the grooves 20 of each frame member 24.

For this purpose the opposing frame members 24 are drilled and threaded as at 34 to receive assembly bolts 36. The cross-members 30 and 32 are drilled to provide recessed holes 38 through their ends to receive the bolts 36. When assembled and the bolts are tightened with the angle iron mirrors in place, the armor window 11 becomes a rugged assembly and can be easily handled, installed, and removed for dismantling to replace any single irons that may be damaged since the window 11 is adapted to be locked in, removed, and replaced with access from the protected side as a unit.

Although the embodiment of the invention will be described preferably with the angle iron mirrors extending horizontally for a wide angle horizontal view, preferably with the apexes 16 up, it will be noted that in instances where the wide viewing angle is desired to be vertical, the armor window can be installed with the mirror angle irons 10 disposed vertically.

If installed with the angle irons disposed horizontally, the apexes 16 preferably are uppermost to shed dust and also provide easy cleaning. The sides of the cross-members 30 and 32 facing the angle irons 10 are cross-sectionally shaped to provide single or double affects 40 to nest the edges 25 or the apex 16 of the respective angle iron adjacent thereto.

Figure 5:
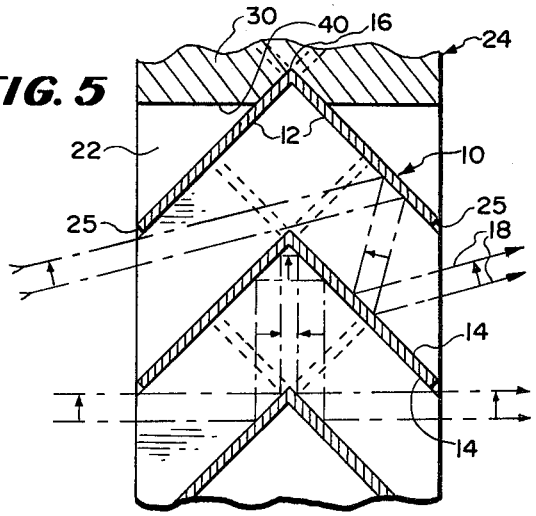
FIG. 5 is a cross-sectional view taken on line 5—5 of FIG. 3 illustrating the non-inversion of reflected images.

All sides of each angle iron 10 are optically flat and are either highly polished, treated or otherwise coated with a reflective surface to provide mirror surfaces spaced in assembled relationship to assure that all optical bundles of light passing between the angle irons, as represented by parallel rays 18 (FIG. 5) and miscellaneous rays 21 (FIG. 6), are subjected to either double or quadruple reflections in an optical system which involves combinations or double mirrors that are disposed in pairs at right angles to each other and parallel thereto between pairs whereby an image reflected from a first mirror is an inversion picked up by the second mirror where it is re-oriented and reflected in a direction parallel with the initiating ray. The pairs of right angle double mirrors thus orient and correct image inversion in the plane of reflection, and a person will be seen through the window oriented for upright sight perception. Thereby, images seen through the mirrors are equivalent to a natural direct view through a glass window in case it is necessary in law to correctly identify a person if the identification through the mirrored window is ever questioned as a "mirrored image."

Accordingly, the armor window 11 provides at least two spaced flanges of angle irons 10 as barriers to arrest the passage of a bullet even if directed in an inclined direction that otherwise would not be likely to strike personnel on the opposite side. At least three spaced walls are encountered with resulting deflections if the original path of a bullet might have struck personnel. If the angle irons and labyrinths of deflection do not arrest the bullet completely, its energy is greatly minimized and terminal deflections greatly reduce the chances of a cashier being touched.

Referring to FIGS. 5—9, modifications of the embodiment are illustrated in which alternate angle irons 10A are pivotally mounted to cooperate with the fixed angle irons 10 to serve as a shutter in blocking vision through the armor window without blocking sound or movement of air and still serve as armor obstructing the flight of a projectile through it.

In this arrangement the movable angle irons 10A are shorter in length and support journals 42 welded to their ends that are received in bearings 44 provided in the opposing frame members 24A. The journals extend beyond frame members 24A to receive crank arms 46 in end grooves 48 where they are secured against radical dislodgement by suitable means such as a screw or pin 50. A cover plate 52 is secured by screws (not shown) to the outside face of the frame member 24A and has recesses 54 for accommodating the crank arms 46 in their movement as well as holding them in engagement with the journals. The crank arms 46 extend laterally towards the cashier and are pivotally yoked together to operate in unison as controlled by an actuating rod 56 exposed solely to the control of the cashier. This control may be manual or automatic, either by a time clock, the cashier directly, or, by an alarm de-energizing a solenoid diagrammatically represented at 58 in FIG. 6.

Since optical considerations are important with the use of the armor window when it is open, the crank arms are resliently urged to a terminal open position that is varied by a minor adjustment 60 (FIG. 6) to zero-in each movable angle iron 10A independently with the adjacent fixed angle irons. The adjustment 60 comprises a cam ring 62 secured on the face of one of the frame members 24 where it is concealed or inaccessible from the outer side of the window yet is readily adjustable on the inner side of the window by a screw 64. Once adjusted for line linearity with a conventional diagonal line screen viewed through the window, further adjustment will rarely be required.

Preferably, the relationship is provided wherein the de-energization of the solenoid 58 drops the yoke rod 56 to move the angle irons 10A to their closed position where it may be latched or locked as desired. The lower face of the inner flange of one of the angle irons 10A may have a decal on it reading "closed" as exposed for ready reading from the outside.

For pivoting the movable angle irons 10A the journals 42 secured on the end of the movable irons are preferably positioned to re-inforce the ends of both flanges 12 of each movable iron 10A, and, to have its pivotal axis 66 thereof so located that the blockage of direct vision through the armor window is maintained throughout the movement. The journal should be of adequate diameter to accomplish both conditions.

Geometrically, if the angle irons 10 and 10A are considered as cross-sectionally defining right triangles with three adjacent angle irons defining three contiguous triangles in which the apexes 16 encroach upon the hypotenuses 67 (FIG. 6), it will be appreciated that pivotal movement of the movable triangle preferably should not break any mutually transgressing relation between triangles when "closing" the window.

Figure 6:
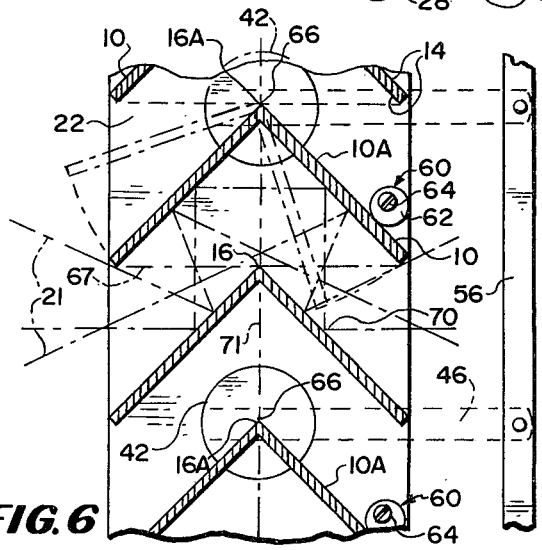
FIG. 6 is a cross-sectional view of the angle iron mirrors illustrating another embodiment of the invention illustrated in FIG. 5.
Figure 9:
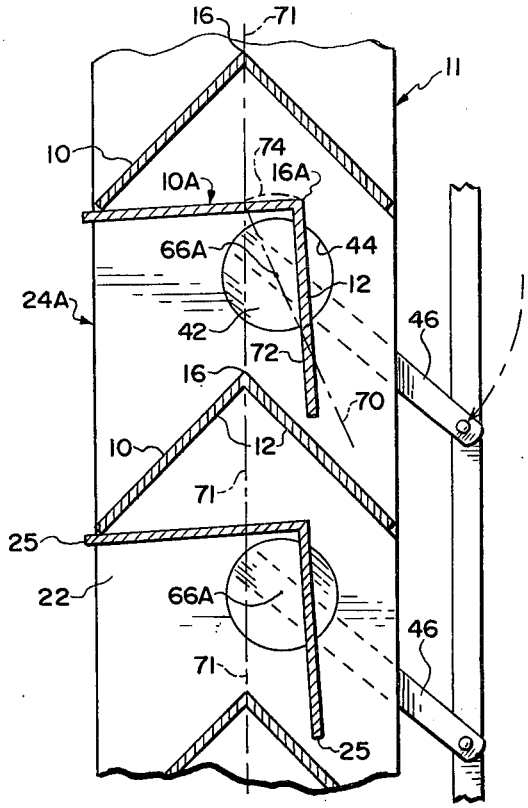
FIG. 9 is a cross-sectional view similar to FIG. 6 showing the adjustment of the angle irons illustrated in FIG. 7 to obstruct sight.
Figure 8:
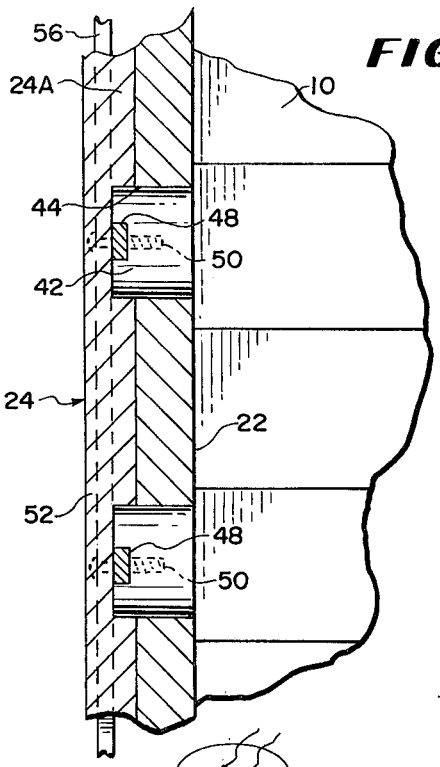
FIG. 8 is a sectional view of the embodiment illustrated in FIG. 7.
Figure 7:
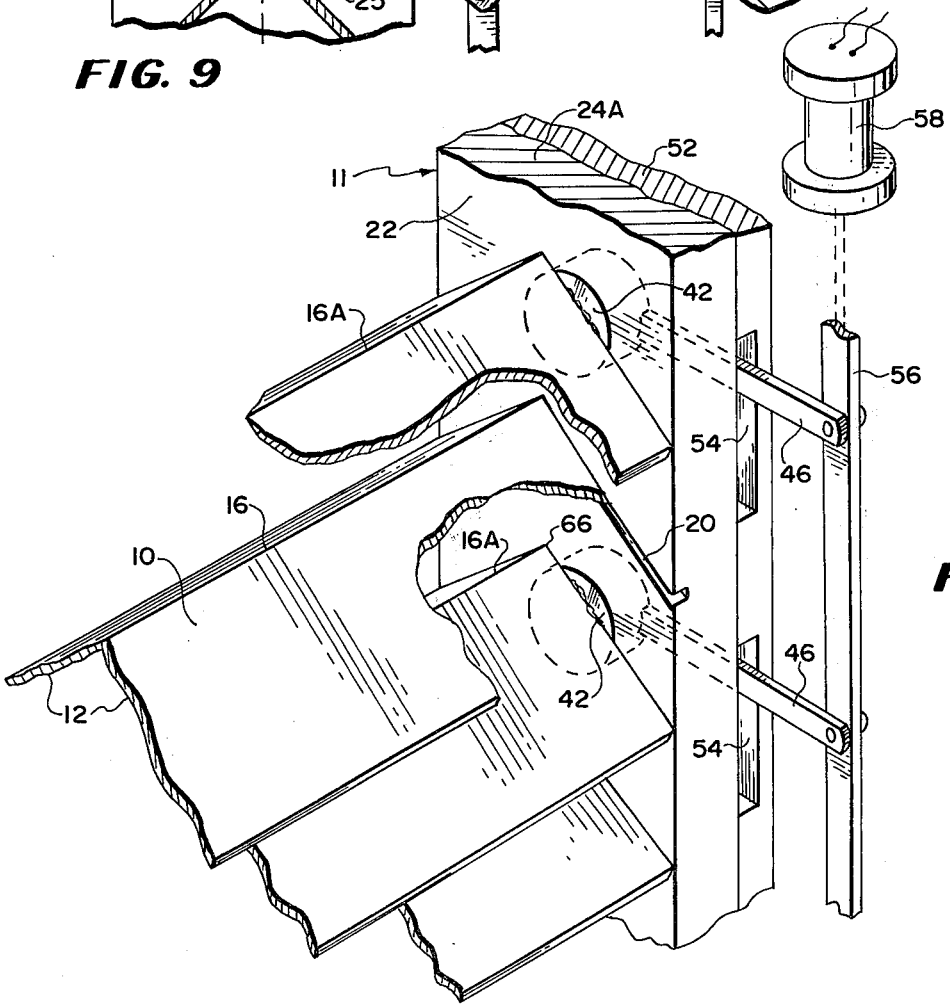
FIG. 7 is a perspective view of a further embodiment of the invention partly in section whereby sight through the window may be obstructed.

Thus, considering that any pivotal movement of the movable triangle will displace its apexes 16A (FIG. 9), unless the apexes and the pivotal axis 68 coincide, as illustrated in FIG. 6, it has been found to be preferable that the pivot axis 66 should intersect the center line 71 defined by all fixed apexes 16 and be located as near or above the apex of the movable triangle for it to swing in a manner similar to a bell, and, a suitable stop (not shown) for the yoke rod 56 is provided to avoid one of the flange edges of the movable angle irons 10A contacting a reflective face of the adjacent flange thereabove while still leaving adequate space for the passage of sound and air between the other flanges.

In case the face 72 (FIG. 9) of one of the flanges is to be approximately perpendicular for clear readability of any printing thereon, such as "closed," the pivotal axis 66A should pass within the imaginary triangle defined by the movable angle iron 10A. This will locate the axis below the apex 16A thereof. In this case, to avoid the apex 16A swinging down out of encroachment upon the triangle above it, either the original overlap must be great enough to start with to avoid separation, or, the pivot axis 66A must be located laterally of the center line 71 and be the center of the circle defined by the arc 74 traversed by the apex when swung vertically a distance limited enough that the arc will not be tangentially deep enough to break overlap with the stationary triangle below it.

For this relationship, the intersection of the pivotal axis 66A is with a line 70 (FIG. 9) that preferably is perpendicular to the apex line of the movable angle iron 10A and extends through the center of that circle defined by the arc which is transcribed by the apex line 16A as it arcs upwardly and laterally in the closing movement of the angle iron 10A with respect to the apexes of the stationary angle irons. Thereby, the moving apex continuously transgresses upon the hypotenuse of the stationary triangle above it while at the same time keeping the apex of the stationary triange below it within the movable triangle. In the relationship shown in FIG. 9 the edges of the relative moving flanges serve as stops without damage to the mirror surfaces.

What is claimed is:

1. An armor window comprising:

a frame including symmetrically opposing side members and opposing end members;

a plurality of angle irons each having two depending flanges disposed at right angles to each other and joined along proximate upper edges to form an apex, said angle irons defining optically flat mirror surfaces on the outer and inner sides of both flanges;

means for supporting said angle irons at their opposite ends upon said opposing side members with said flanges and apexes spaced from each other for movement of air and sound between them and said apexes being disposed on a center line and spaced a distance less than approximately one-half the width of one of said flanges for continuous overlapping of flanges with their apexes parallel with each other to interrupt direct lines of sight between the angle irons;

said supporting means including opposing support journals secured to the opposite ends of said alternate angle irons;

bearing means for journalling said opposing support journals in said opposing side members for pivotally supporting the alternate angle irons upon axes disposed in close proximity to the apexes of said angle irons;

means for rotating said journal means including radially extending elements on said journal means; and manually controlled means for actuating said extending elements in unison.

2. The armor window defined in claim 1 in which said journal means pivotally supports opposite ends of alternate angle irons on said opposing frame members with the pivotal axis at each end intersecting a line intersecting said center line and the center of a circle defined by any arcuate movement of the apexes laterally away from said center line to dispose one side of the pivoted angle iron substantially vertically when the angle iron is at one limit of its tilting movement.

3. The armor window defined in claim 1 in which:

the journal means on opposite ends of alternate angle irons journalled in opposing frame members are disposed upon axes that are substantially coincident with the apex of said movable member; and includes stop means for limiting movement of said movable angle iron.

4. The armor window defined in claim 1 including:

means for individually adjusting the resting position of each movable angle iron with respect to the rigidly mounted angle irons coacting therewith to reflect light rays.

* * * * *